US006088879A

United States Patent [19]

Gasser

[11] Patent Number: 6,088,879

[45] Date of Patent: Jul. 18, 2000

[54] HINGE

[75] Inventor: Ingo Gasser, Höchst, Austria

[73] Assignee: Julius Blum Gesellschaft m.b.H., Höchst, Austria

[21] Appl. No.: 09/104,010

[22] Filed: Jun. 24, 1998

[30] Foreign Application Priority Data

Jun. 25, 1997 [AT] Austria ..... 1090/97

[51] Int. Cl.[7] ..... E05D 7/10

[52] U.S. Cl. ..... 16/257; 16/258

[58] Field of Search ..... 16/257, 258, 261, 16/270, 272; 292/DIG. 9, DIG. 53; 24/613, 657, 658; 403/325

[56] References Cited

U.S. PATENT DOCUMENTS

| | | | |
|---|---|---|---|
| 4,800,622 | 1/1989 | Rick et al. | 16/240 |
| 4,976,006 | 12/1990 | Lautenschlager | 16/257 |
| 5,025,530 | 6/1991 | Ferrari et al. | 16/258 |
| 5,056,189 | 10/1991 | Brustle et al. | 16/258 |
| 5,056,190 | 10/1991 | Rock et al. | 16/257 |
| 5,062,180 | 11/1991 | Lautenschläger, Jr. | 16/257 |
| 5,210,907 | 5/1993 | Toyama | 16/258 |

FOREIGN PATENT DOCUMENTS

| | | |
|---|---|---|
| 0 369 532 | 5/1990 | European Pat. Off. . |
| 38 16 838 | 10/1989 | Germany . |

*Primary Examiner*—Chuck Y. Mah

*Attorney, Agent, or Firm*—Wenderoth, Lind & Ponack, L.L.P.

[57] ABSTRACT

A hinge has a hinge arm (5, 15) which is mounted on a mounting plate (10, 16) directly, or indirectly by way of an intermediate plate (8), and is rotatably connected by way of at least one hinge pivot to a hinge cup (4) securable to a door (3) of an article of furniture. The hinge arm (5, 15) is fixed on the mounting plate (16) or intermediate plate (8) by a spring-loaded locking member. The locking member is formed by two shackle parts (6) which are displaceably held in the hinge arm (5, 15) and, in the locked position, hook in behind projections (23, 23') arranged on lateral webs (21, 21') of the mounting plate (16) or of the intermediate plate (8). The shackle parts (6) each have a C-shaped portion (7) which embraces one of the lateral webs (21, 21') of the mounting plate (16) or of the intermediate plate (8).

11 Claims, 9 Drawing Sheets

HINGE

BACKGROUND OF THE INVENTION

Field of the Invention

The invention relates to a hinge having a hinge arm which is mounted on a mounting plate and is rotatably connected by way of at least one hinge pivot to a fasten-on part securable to a door of an article of furniture, the hinge arm being fixed on the mounting plate by means of a spring-loaded locking member.

SUMMARY OF THE INVENTION

The object of the invention is to provide a hinge in which the hinge arm can be both mounted on the mounting plate and demounted quickly and without tools, the hinge or that is to say the mounting plate being required to be secured not to a side wall of the article of furniture but to a frame connected to a side wall of the article of furniture.

The object according to the invention is achieved in that the locking member is formed by at least one shackle part which is displaceably held in the hinge arm and, in the locked position, hooks in behind projections arranged on lateral webs of the mounting plate.

The mounting plate may be designed either in one piece or in two parts comprising a base plate and an intermediate plate.

Advantageously, provision is made for the shackle part to have a C-shaped portion which embraces one of the lateral webs of the mounting plate, the free limbs of the C-shaped portion latching in behind the projections of the lateral web in the locked position.

In the mounted position, the free limbs of the C-shaped portions of the shackle parts press onto the lateral webs of the mounting plate or of the intermediate plate from above and from below. As a result, the hinge arm may be pressed onto the mounting plate both in a straight manner and forwardly or rearwardly tilted manner. The mounting of the door wing is thereby facilitated.

In order to achieve an. anchoring of the hinge arm in a manner secure against tilting, two shackle parts directed toward one another are provided in one exemplary embodiment of the invention, the direction of displacement of the shackle parts running parallel to the hinge pivot.

A constructionally simple and secure anchoring of the shackle parts in the hinge arm is achieved in that the shackle part or the shackle parts is or are guided in holes in lateral webs of the hinge arm which are oriented perpendicularly to the hinge pivot.

In a further exemplary embodiment of the invention, the support and guidance of the shackle part or of the shackle parts is improved in that the shackle part has a lengthened arm which is oriented parallel to the hinge pivot and on which the spring, designed as a helical spring, is mounted.

In the case where two shackle parts are mounted in the hinge arm, provision is advantageously made for a helical spring to surround the lengthened arms of the two shackle parts directed toward one another and for the lengthened arms of the shackle parts to overlap one another.

In order to prevent the hinge arm from being unintentionally detached from the mounting plate, provision is made in one exemplary embodiment of the invention for a cap which covers the hinge arm and, in the mounted position, projects, above and below the hinge arm, with webs between the side walls of the hinge arm and the shackle parts.

DESCRIPTION OF THE DRAWING

Various exemplary embodiments of the invention are described below with reference to the figures of the accompanying drawings, wherein.

DESCRIPTION OF THE PREFERRED EMBODIMENTS

Figure 1:
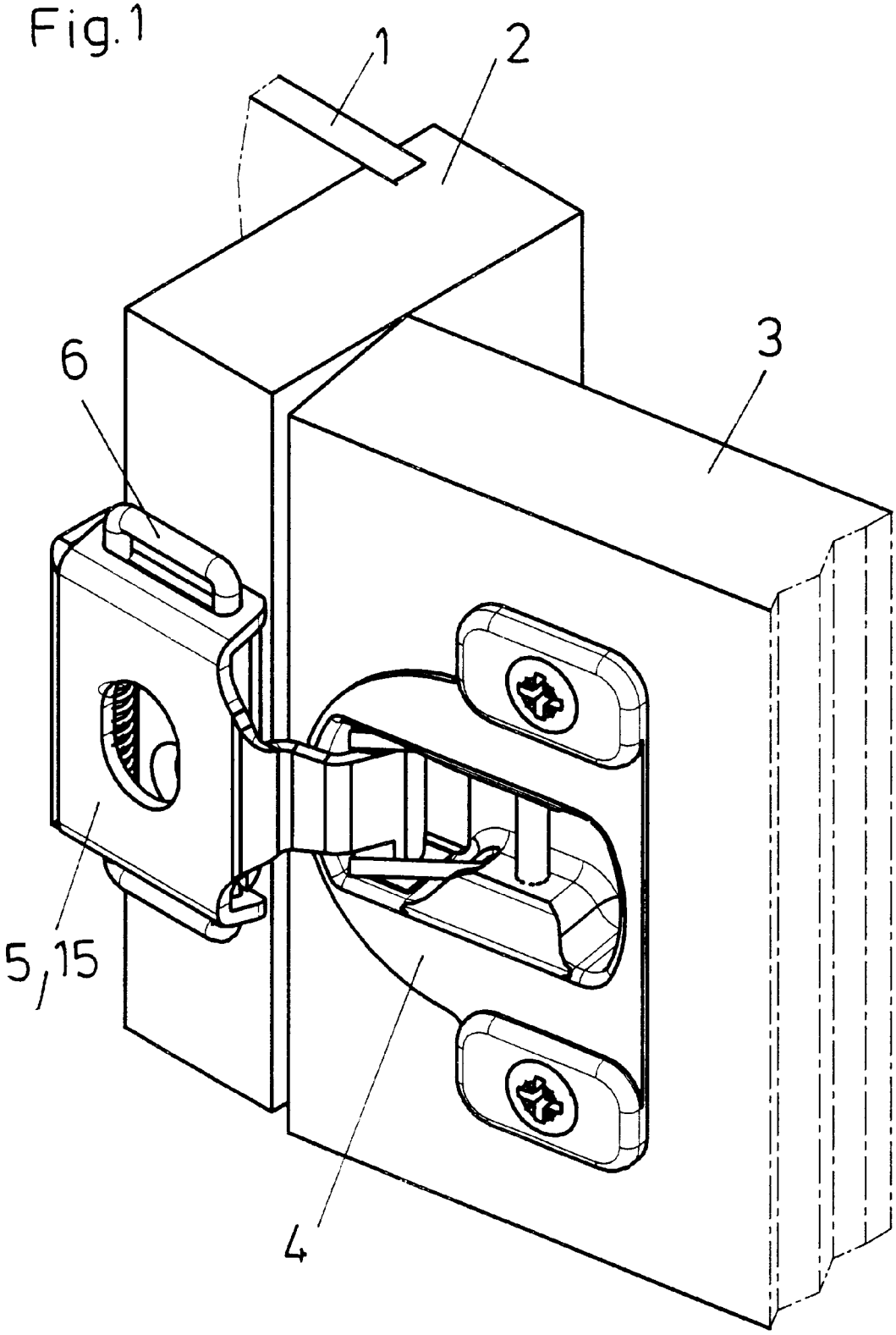
FIG. 1 shows a diagram of a hinge according to the invention, including portions of the side wall of the article of furniture, of the frame and of the door of the article of furniture.
Figure 2:
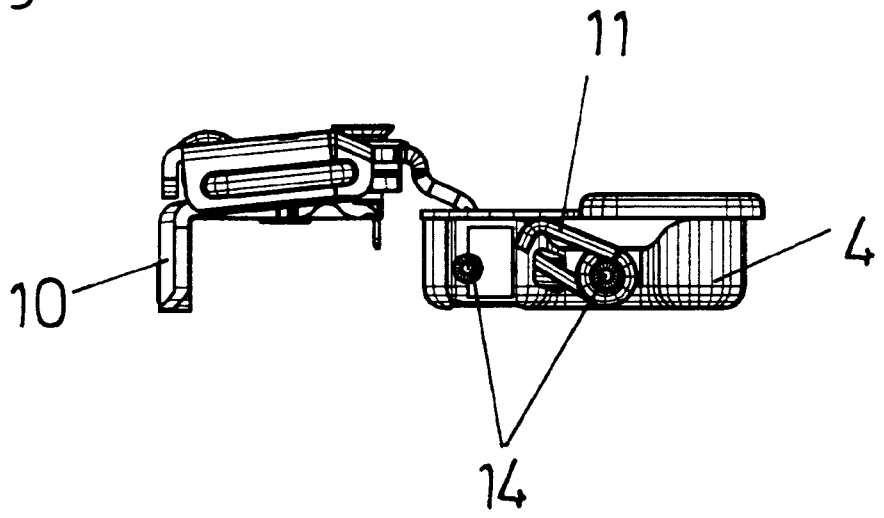
FIG. 2 shows a side view of a hinge.
Figure 3:
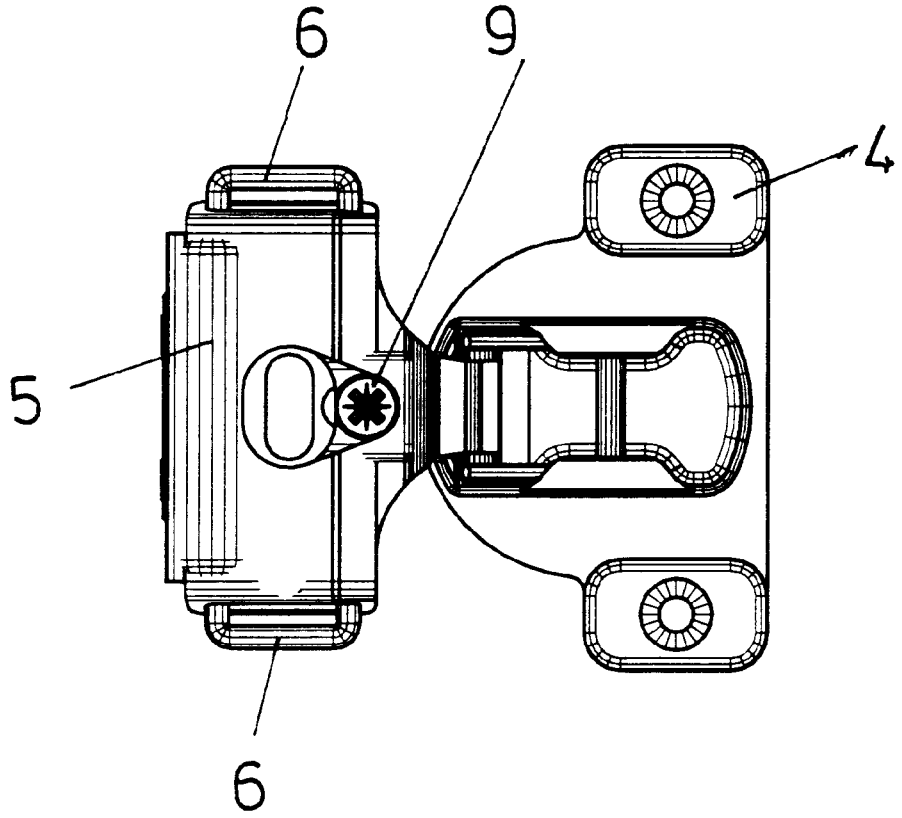
FIG. 3 shows a plan view of a hinge according to the invention.

By means of the hinge according to the invention, a door 3 of an article of furniture is secured to a frame 2 of the article of furniture which frontally covers a side wall 1 of the article of furniture. Since the weight of the door 3 of the article of furniture is carried by the frame 2 of the article of furniture, the side wall 1 of the article of furniture may be produced from thinner material than a conventional side wall. A hinge cup 4 is inserted into a bore in the door 3 of the article of furniture in the conventional manner and has a hinge pivot, by way of which it is connected to a hinge arm 5, 15. The hinge pivot is formed by an arm 14' of a shackle 14 which projects through openings 18 in the hinge cup 4. On a second arm 14" of the shackle 14 are mounted springs 11 which press onto the hub 12 of the hinge arm 5, 15. When the door 3 is almost closed, the springs 11 cause the hinge cup 4 and thus the door 3 to be pulled into the final closed position and held in this position. The arm 14" of the shackle 14 projects through holes 19 in the hinge cup 4.

Figure 4:
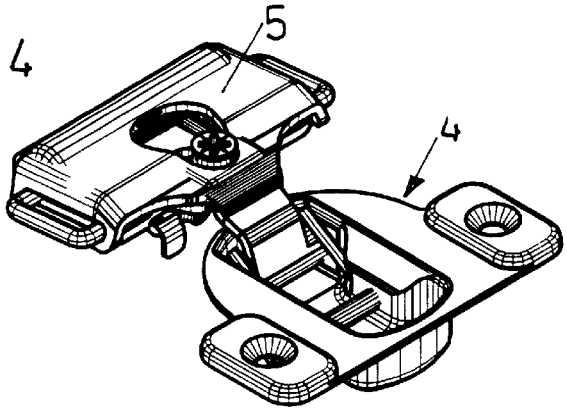
FIG. 4 shows a diagram of a hinge according to the invention
Figure 5:
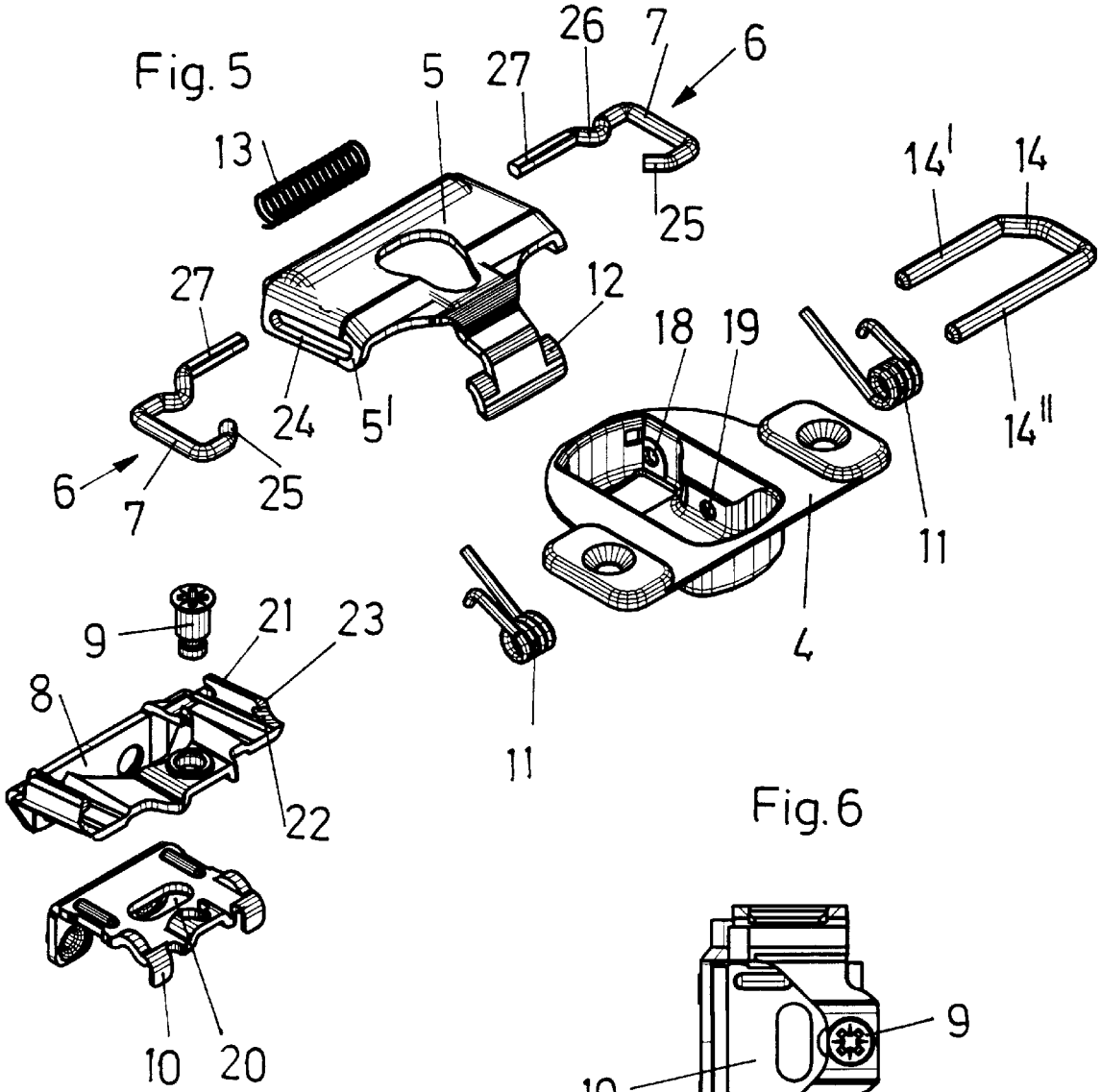
FIG. 5 shows a diagram of a hinge according to the invention in which the individual parts are shown disassembled.
Figure 6:
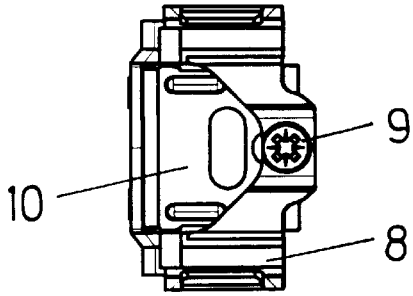
FIG. 6 shows a plan view of the base plate and intermediate plate.

In the exemplary embodiment according to FIGS. 4 and 5, the mounting plate is designed in two parts. It comprises the base plate 10, which is secured to the frame 2 of the article of furniture, and an intermediate plate 8. The intermediate plate 8 is held on the base plate 10 by means of a gap adjusting screw 9.

The base plate 10 has an elongated hole 20, through which projects a fastening screw (not shown) which is anchored directly in the frame 2 of the article of furniture. The elongated hole 20 allows adjustment of the base plate 10 and thus of the hinge in the direction of the height of the article of furniture.

Figure 7:
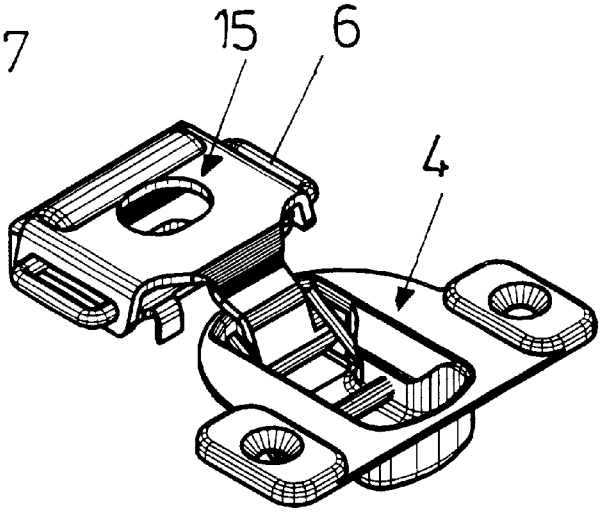
FIG. 7 shows a diagram of a hinge according to a further exemplary embodiment of the invention.
Figure 8:
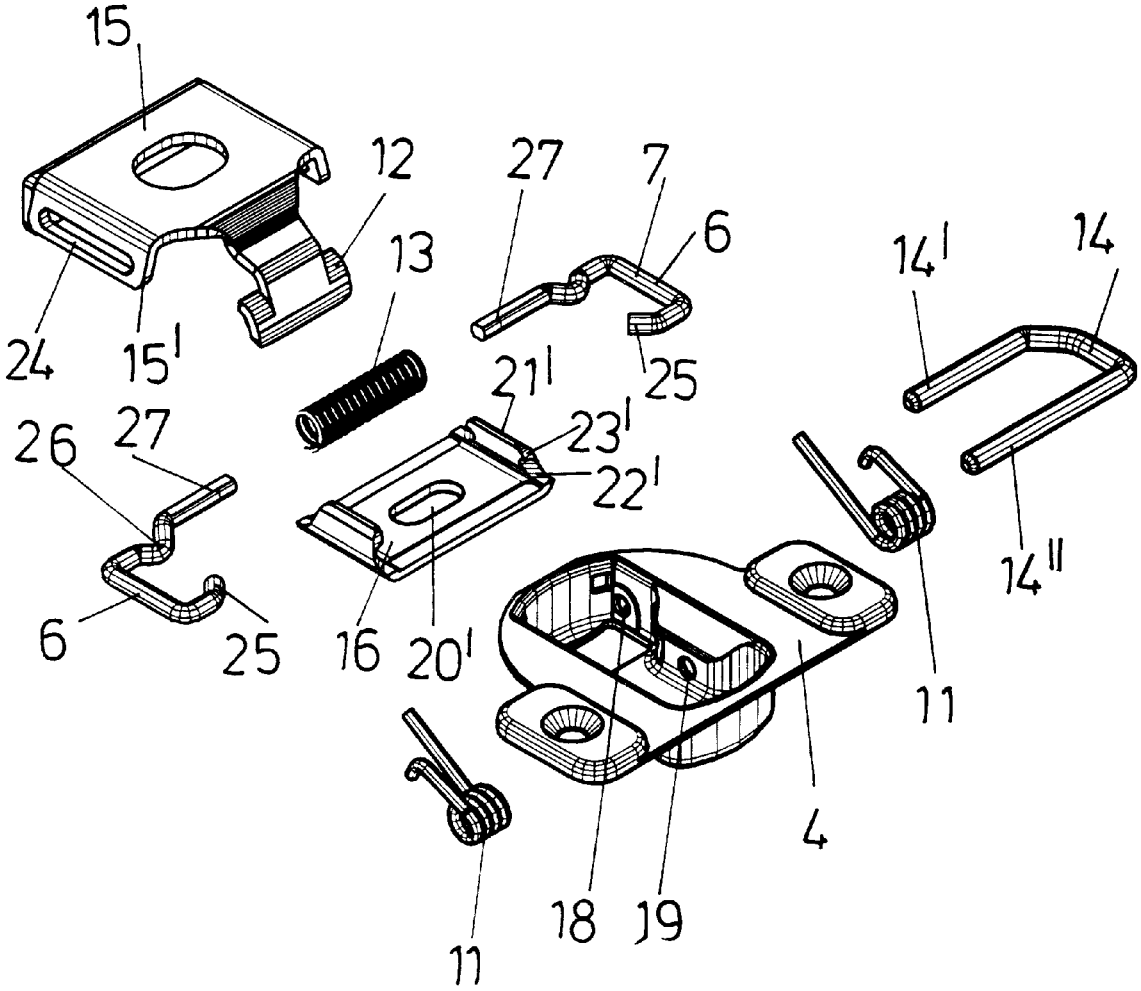
FIG. 8 shows a diagram of the same hinge in which the parts are drawn disassembled.
Figure 13:
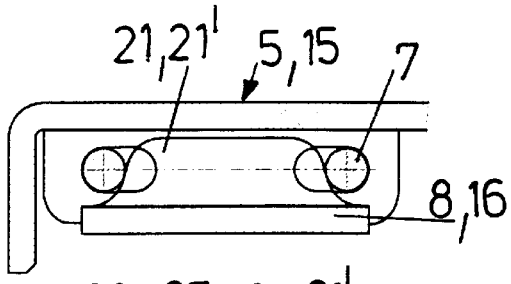
FIG. 13 shows a section taken on the line C—C of FIG. 11.
Figure 12:
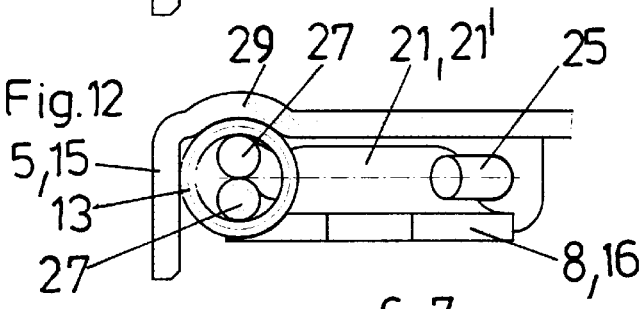
FIG. 12 shows a section taken on the line B—B of FIG. 11.

The intermediate plate 8 is provided with in each case one lower and one upper lateral web 21 (in relation to the mounted position on the article of furniture). On the inner side of each of the lateral webs 21 are formed notches 22 which delimit projections 23 at the free edges of the lateral webs 21. In the exemplary embodiment according to FIGS. 7 and 8, the lateral webs 21' are formed directly on the mounting plate 16. The lateral webs 21' correspond to the lateral webs 21 of the exemplary embodiment of FIGS. 4 and 5 and they have notches 22' which delimit projections 23'.

The one-piece mounting plate 16 is again provided with an elongated hole 20' which is vertical in the mounted position and allows height adjustment of the mounting plate 16 and thus of the hinge on the frame 2 of the article of furniture.

The hinge arms 5, 15 have lateral webs 5', 15' in which there are holes 24. The holes 24 are designed as elongated holes. Through the holes 24 project shackle parts 6 directed toward one another. The shackle parts 6 each have a C-shaped portion 7 with free limbs 25. One of the free limbs 25 of each shackle part 6 merges into a lengthened arm 27 by way of a V-shaped portion 26. The lengthened arms 27 project into a spring 13 designed as a helical spring. The spring 13 is a compression spring and pushes the shackle parts 6 apart.

The lengthened arms 27 are provided with stops (not shown) which prevent the shackle parts 6 from being able to fall out of the hinge arm 5, 15 before the hinge arm 5, 15 has been pressed onto the mounting plate 16 or the intermediate plate 8.

In order to fix the door 3 of the article of furniture on the frame 2 of the article of furniture, the hinge arm 5, 15 can be pressed onto the mounting plate 16 or the intermediate plate 8, as shown in FIGS. 17 to 21.

In this procedure, the shackle parts 6 are pressed toward one another preferably with thumb and forefinger, so that the C-shaped portions 7 can be fitted onto the lateral webs 21, 21' of the intermediate plate 8 or of the mounting plate 16.

Figure 10:
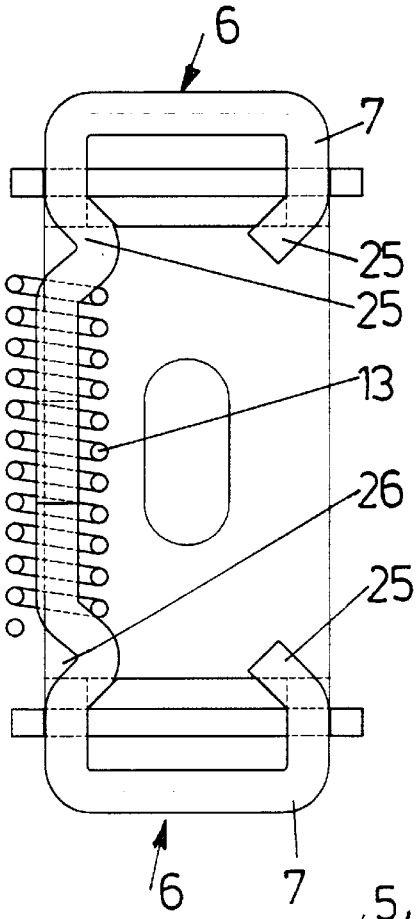
FIGS. 10 and 11 each show a section along the line A—A of FIG. 9, the locked position of the hinge arm being shown in FIG. 10 and the detached position of the hinge arm being shown in FIG. 11.
Figure 11:
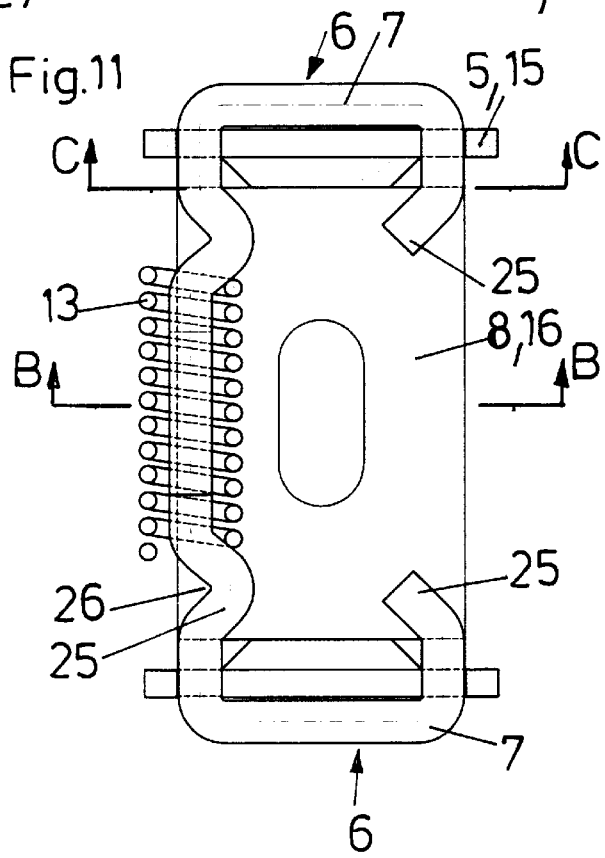
Figure 9:
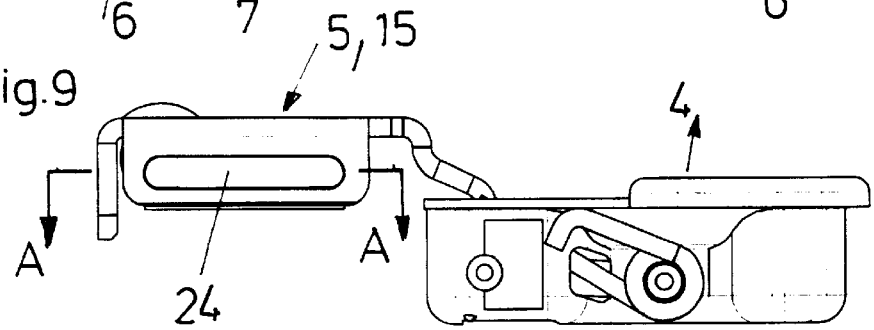
FIG. 9 shows a side view of the hinge.
Figure 14:
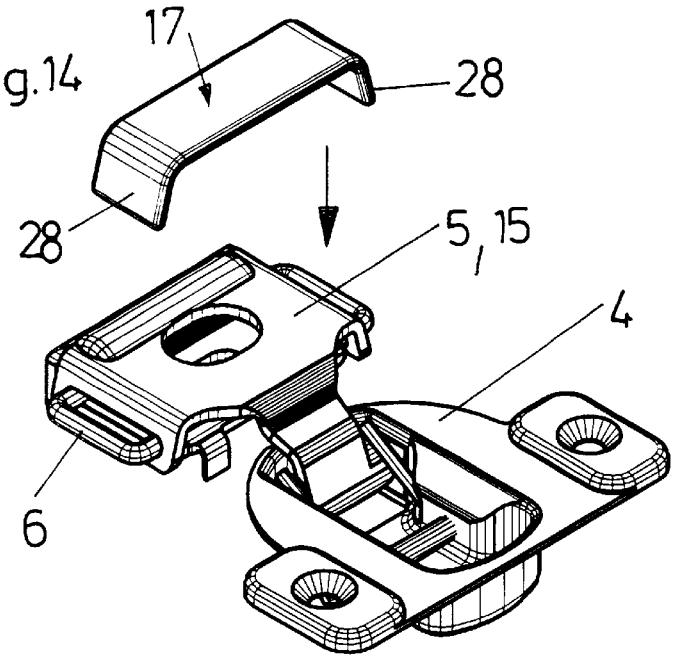
FIG. 14 shows a diagram of a hinge and of a cap serving for securing the hinge arm.
Figure 15:
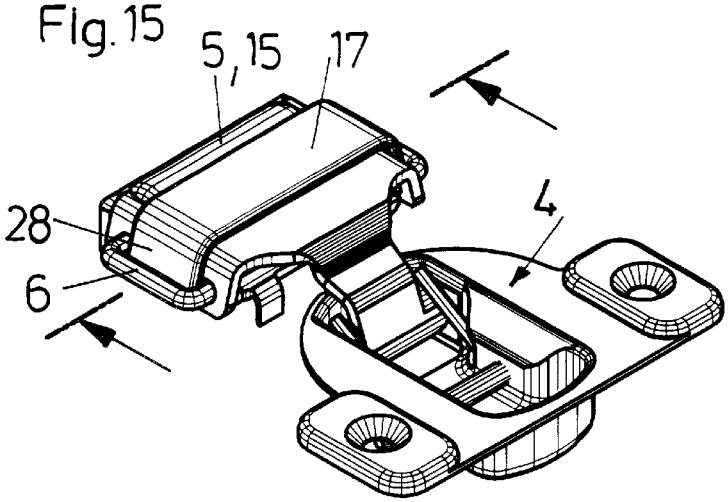
FIG. 15 shows a diagram of the hinge with fitted cap.
Figure 16:
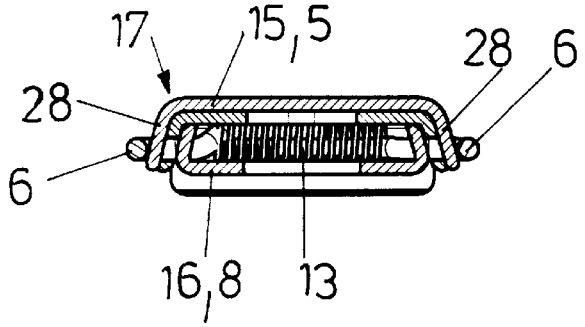
FIG. 16 shows a longitudinal section through the cap, the hinge arm and the mounting plate, and FIGS. 17 to 22 each show a schematic view of the hinge, the hinge cup being shown in side view and the hinge arm in section, and the hinge arm in FIGS. 17 to 21 being shown in the movement in which it is pressed onto the mounting plate and in FIG. 22 in the position in which it is arrested on the mounting plate.
Figure 17:
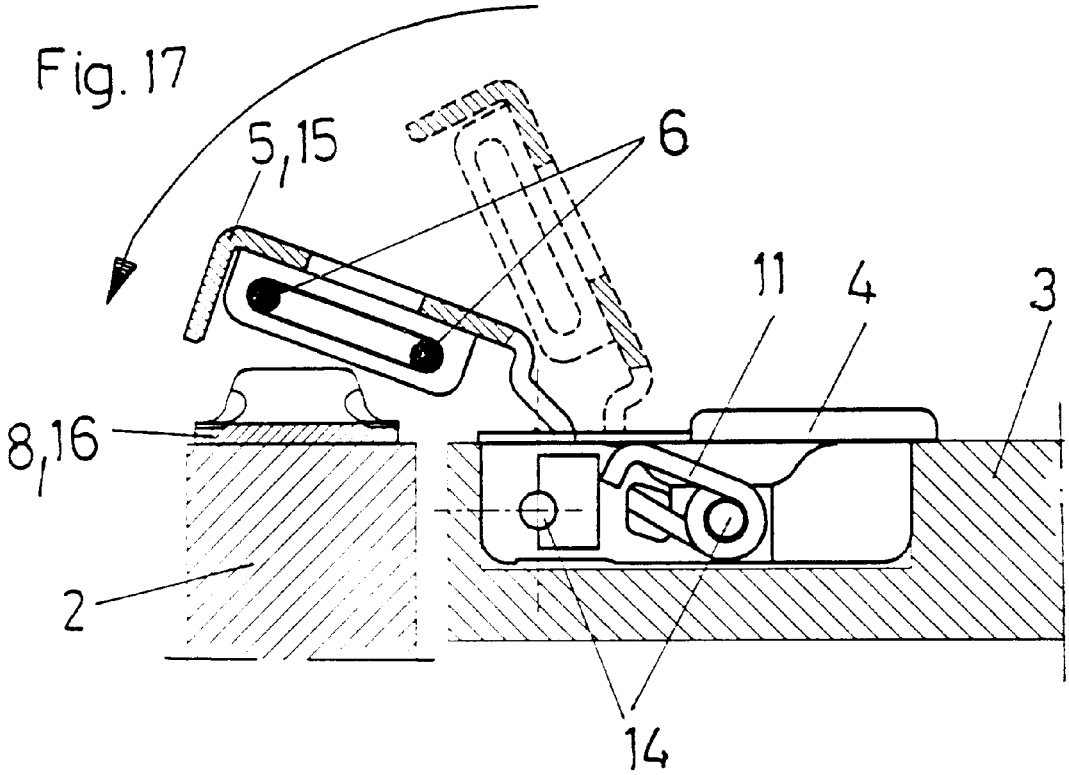
Figure 18:
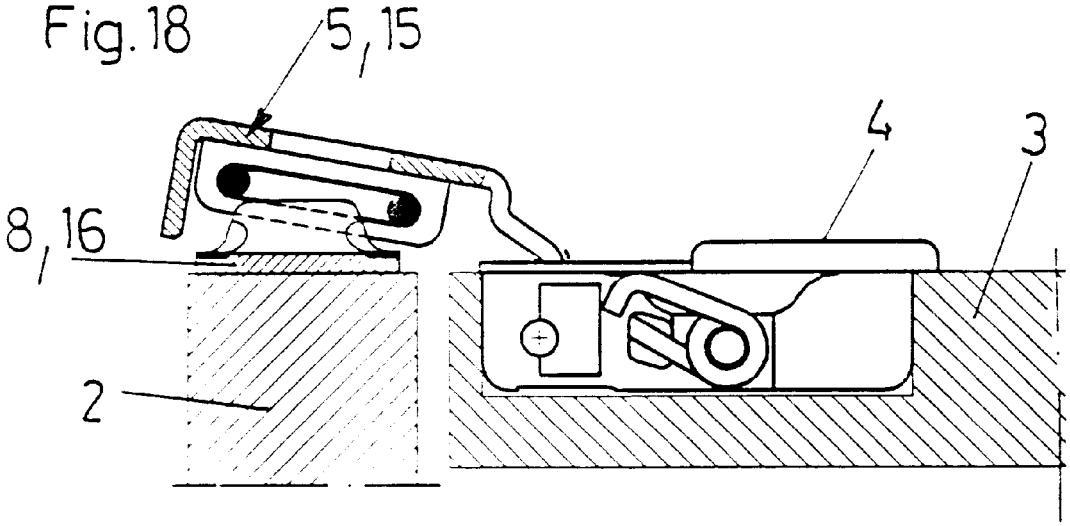
Figure 19:
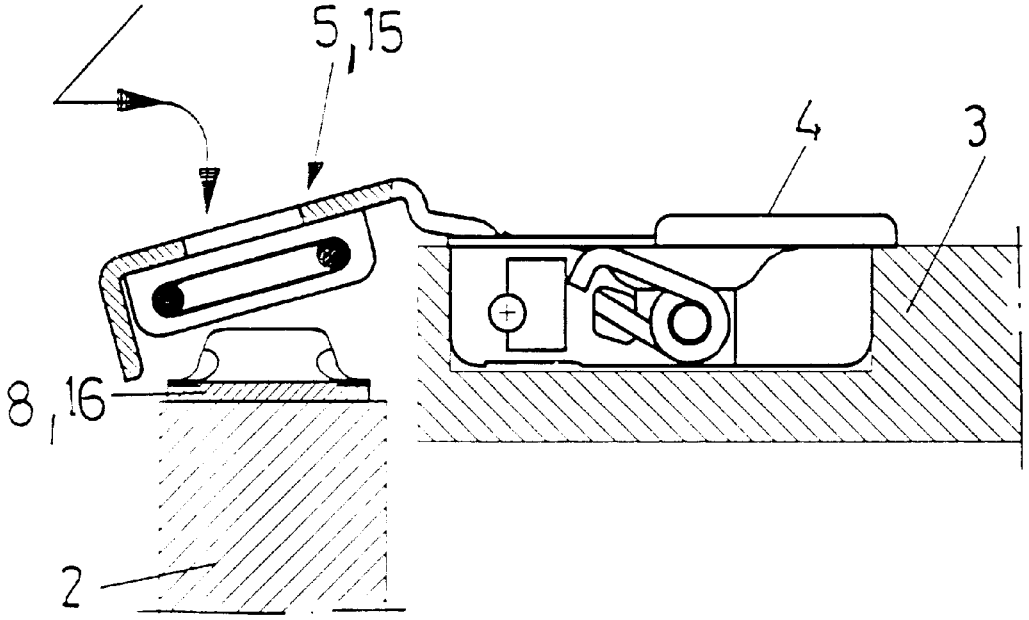
Figure 20:
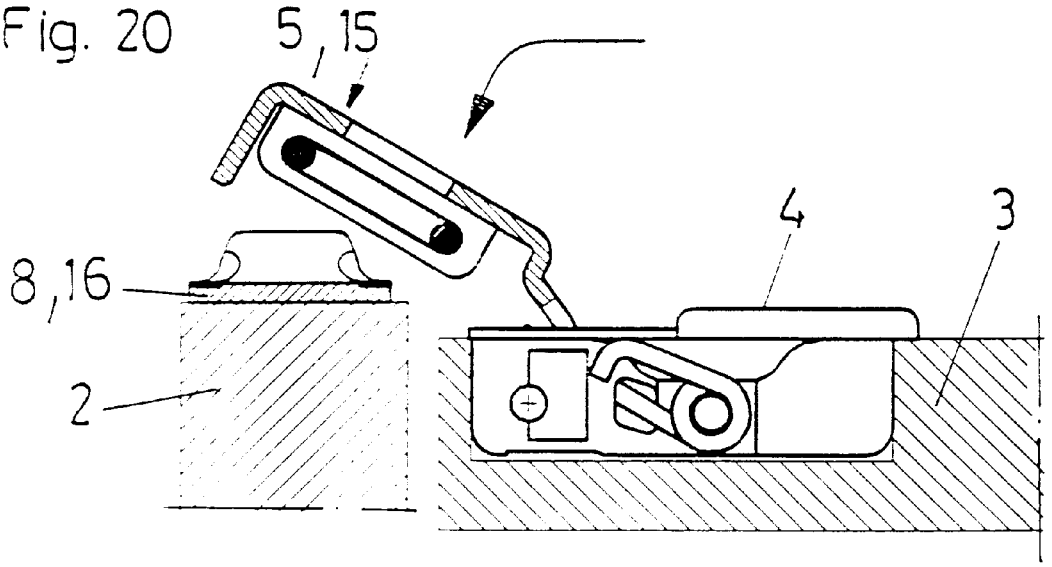
Figure 21:
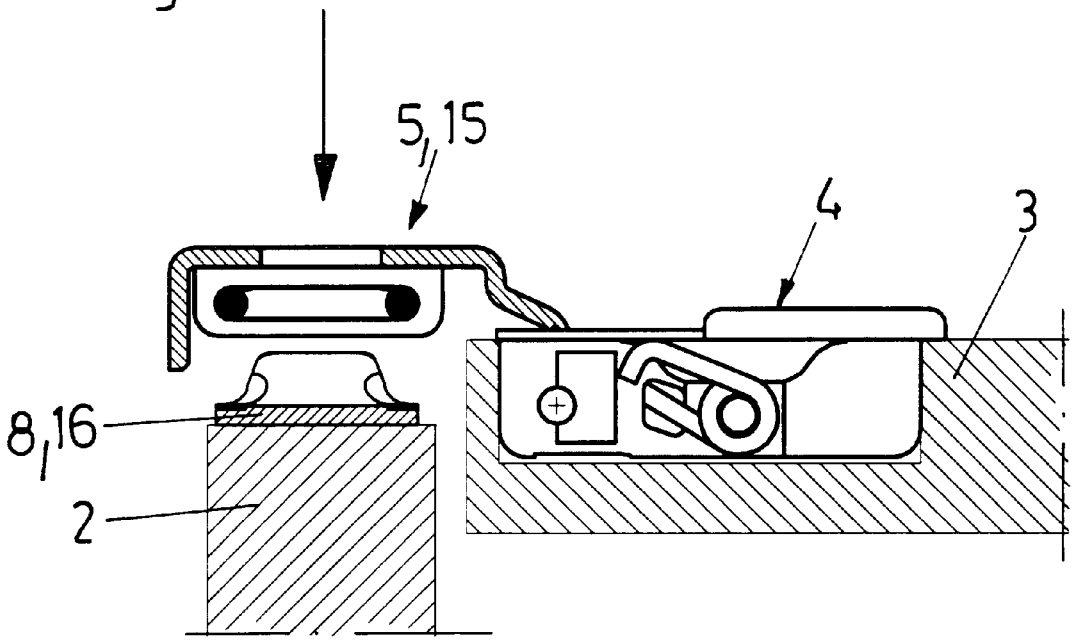
Figure 22:
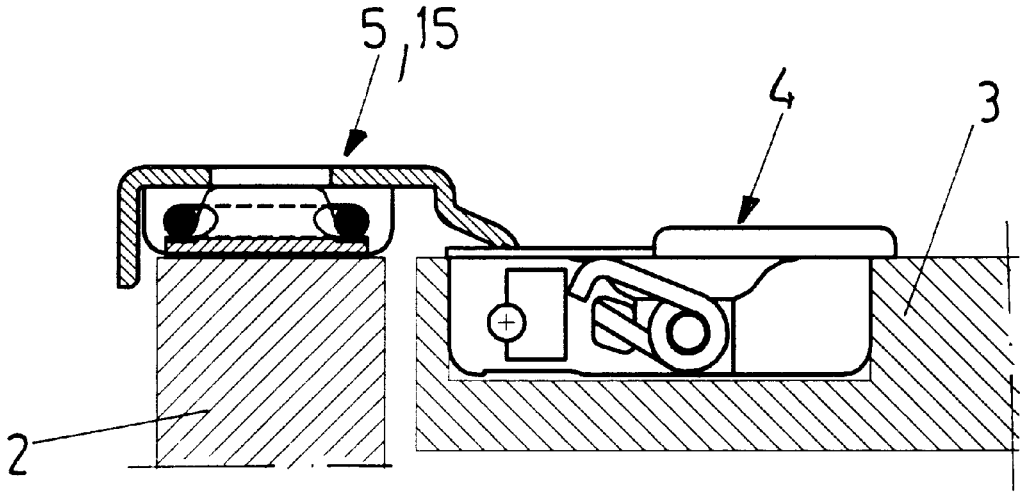

In the position of the hinge arm shown in FIG. 22, the shackle parts 6 are released and the spring 13 pushes the shackle parts 6 apart, so that the free limbs 25 of the C-shaped portions 7 latch into the notches 22, 22' of the lateral webs 21, 21'. This situation is shown in FIG. 10. The shackle parts 6 are thus anchored behind the projections 23, 23' of the lateral webs 21, 21' and hold the hinge arm 5, 15 on the intermediate plate 8 or the mounting plate 16.

In order to allow sufficient space for the spring 13 even in the case of a very narrow hinge arm 5, 15, the hinge arm 5, 15 may be provided with a troughlike indentation.

In order to prevent the shackle parts 6 from being unintentionally pressed together and the hinge arm 5, 15 being detached from the intermediate plate 8 or the mounting plate 16, a cap 17 may be pressed onto the hinge arm 5, 15, the lateral limbs 28 of which cap project between the side walls 5', 15' of the hinge arm 5, 15 and the shackle parts 6. Unintentional pressing together of the shackle parts 6 is thereby prevented.

We claim the following:

1. A hinge for securing a furniture door to an article of furniture, said hinge comprising:

a mounting plate to be mounted on the article of furniture, said mounting plate having a lateral web with projections extending from opposite sides thereof;

a hinge arm fixable to said mounting plate and rotatably connected by at least one hinge pivot to a fasten-on part to be secured to the furniture door; and a spring-loaded locking member to fix said hinge arm to said mounting plate, said locking member comprising at least one shackle displaceably held in said hinge arm and movable to a locked position fixing said hinge arm to said mounting plate, said shackle having a C-shaped portion including free limbs, wherein, when said shackle is in said locked position, said C-shaped portion embraces said lateral web and said free limbs latch behind respective said projections.

2. A hinge as claimed in claim 1, wherein said mounting plate comprises a base plate fixable to the article of furniture, and an intermediate plate adjustably mounted on said base plate, said lateral web and said projections being formed on said intermediate plate.

3. A hinge as claimed in claim 1, wherein said at least one shackle comprises two shackles displaceably held in said hinge arm and directed toward each other.

4. A hinge as claimed in claim 3, wherein each of said shackles includes a lengthened arm, and further comprising a spring mounted on said lengthened arms of said two shackles and urging said two shackles to respective locked positions thereof.

5. A hinge as claimed in claim 4, wherein said lengthened arms of said two shackles overlap one another.

6. A hinge as claimed in claim 1, wherein said at least one shackle is displaceable relative to said hinge arm in a direction parallel to said at least one hinge pivot.

7. A hinge as claimed in claim 1, wherein said hinge arm includes at least one lateral web extending in a direction perpendicular to said hinge pivot, and said at least one shackle is guided in holes in said at least one lateral web of said hinge arm.

8. A hinge as claimed in claim 1, wherein said at least one shackle has a lengthened arm extending parallel to said hinge pivot, and further comprising a spring mounted on said lengthened arm and urging said at least one shackle to said locked position.

9. A hinge as claimed in claim 8, wherein said spring comprises a helical spring.

10. A hinge as claimed in claim 8, wherein said lengthened arm is joined to said C-shaped portion with a V-shaped bend therebetween.

11. A hinge as claimed in claim 1, further comprising a cap fittable on said hinge arm to cover said hinge arm, said cap having at least one lateral limb projecting between a side wall of said hinge arm and said at least one shackle.

* * * * *